United States Patent [19]

Matthews

[11] 4,116,613

[45] Sep. 26, 1978

[54] DIRECT IGNITION SYSTEM WITH INTERLOCK PROTECTION

[75] Inventor: Russell Byron Matthews, Goshen, Ind.

[73] Assignee: Johnson Controls, Inc., Milwaukee, Wis.

[21] Appl. No.: 761,660

[22] Filed: Jan. 24, 1977

[51] Int. Cl.[2] ..... F23H 5/00

[52] U.S. Cl. ..... 431/78; 431/26

[58] Field of Search ..... 431/66, 67, 78, 80, 431/79, 26, 24

[56] References Cited

U.S. PATENT DOCUMENTS

| | | | |
|---|---|---|---|
| 3,830,619 | 8/1974 | Cade | 431/78 |
| 3,832,123 | 8/1974 | Walbridge | 431/78 |
| 3,847,533 | 11/1974 | Riordan | 431/78 |
| 3,892,981 | 7/1975 | Bauer | 431/78 X |
| 3,941,553 | 3/1976 | Bedford | 431/80 |

*Primary Examiner*—Edward G. Favors

*Attorney, Agent, or Firm*—Emrich, Root, O'Keeffe & Lee

[57] ABSTRACT

A control circuit for a fuel ignition system of the direct ignition type for providing an interlock on start-up to prevent the energization of a fuel supply valve of the system under certain failure conditions includes an interlock relay which is energized, after a predetermined delay, over normally closed contacts of a flame relay to control a timing network to cause a flame sensing circuit to enable the flame relay to energize the valve during a trial for ignition interval defined by the timing network, the flame sensing circuit maintaining the flame relay, and thus the valve, energized when a flame is provided during the trial for ignition interval, the energization of the valve and the interlock relay being prevented if the normally closed contacts of the flame relay are open on start-up, and the delayed operation of the interlock relay preventing lockout of the system following momentary loss of power.

23 Claims, 1 Drawing Figure

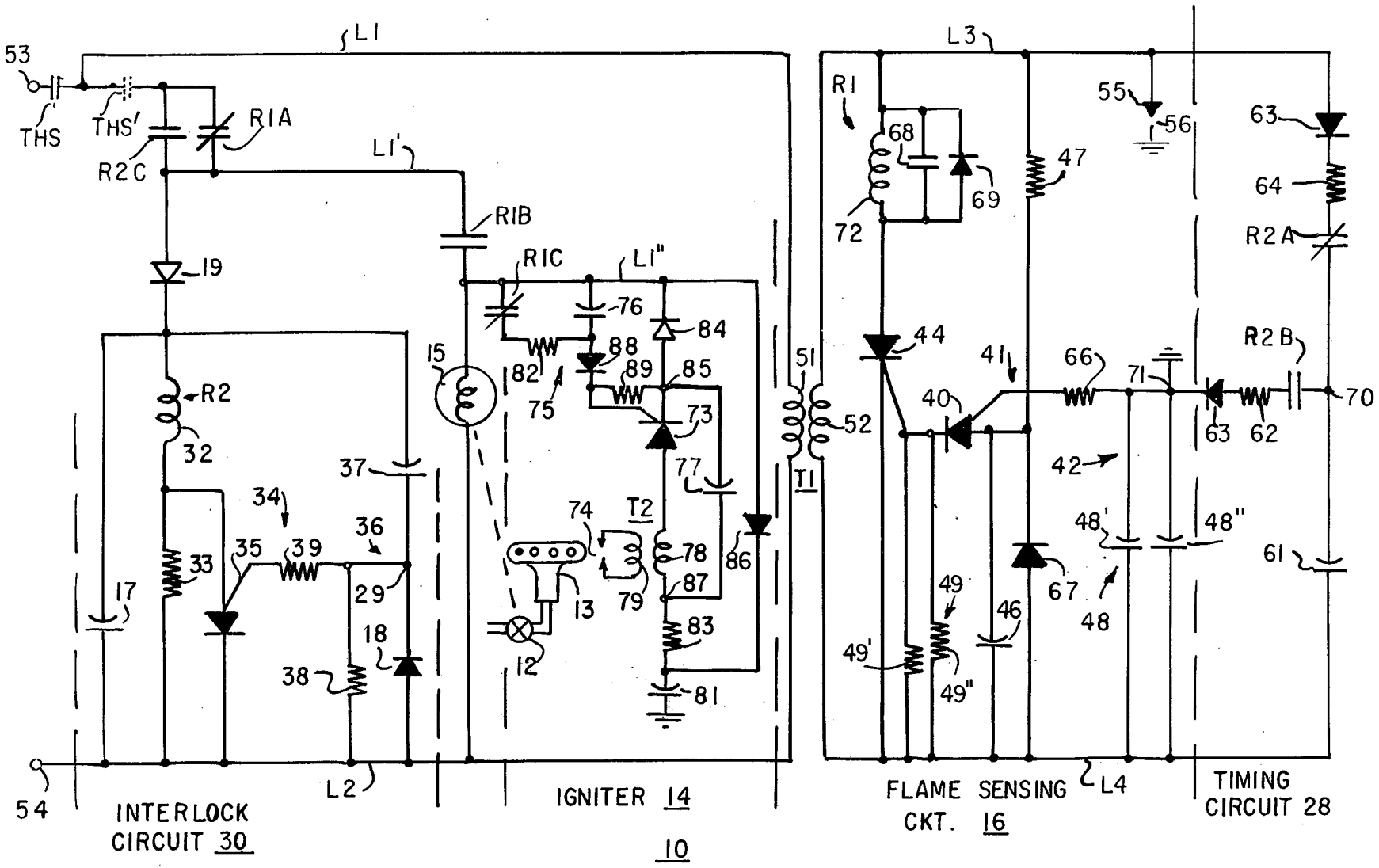
TIMING CIRCUIT 28
FLAME SENSING CKT. 16
IGNITER 14
INTERLOCK CIRCUIT 30
10

DIRECT IGNITION SYSTEM WITH INTERLOCK PROTECTION

BACKGROUND OF THE INVENTION

1. Field of the Invention

This invention relates to fuel ignition systems of the direct ignition type, and more particularly, to a control circuit for use in such systems for providing an interlock which prevents start-up under certain failure conditions.

2. Description of the Prior Art

In known fuel ignition systems of the direct ignition type for use in heating systems, a fuel valve is tentatively operated during a trial for ignition interval in response to the closing of thermostatically controlled contacts, permitting the valve to supply fuel to a burner for ignition to establish a flame. A flame sensing circuit detects the flame and maintains the valve in fuel supplying condition, the valve being deenergized in the event the fuel fails to be ignited within the trial for ignition interval.

Typically, the operation of the fuel valve is controlled by a relay of the flame sensing circuit which has normally open contacts connected in the energizing path for the valve. When energized, the relay closes its contacts to connect the valve to an energizing circuit to permit the valve to operate. When the thermostatically controlled contacts open, the fuel valve is deenergized to interrupt the supply of fuel to the burner whereby the flame is extinguished. The flame sensing circuit responds to the loss of flame to deenergize the relay which opens its contacts to disconnect the valve from the energizing circuit in preparation of the next ignition cycle.

However, should the relay contacts which control the energization of the valve become welded together, following a successful ignition cycle, or for a circuit failure which permits the relay of the flame sensing circuit to remain energized in the absence of a flame, the valve remains connected to the energizing circuit and will be energized the next time the thermostatically controlled contacts close, and will remain energized even though the fuel fails to be ignited, permitting fuel to emanate from the burner, unlit, an undesirable condition.

Also, many systems employ an RC timing circuit to define the trial for ignition interval. In such timing circuits, the timing is changed, that is increased, if the capacitor becomes leaky or if the resistance increases as by bad solder joints. An increase in the trial for ignition period resulting from a change in the timing circuit permits unburned fuel to emanate from the fuel outlet for a longer time, a potentially hazardous condition.

SUMMARY OF THE INVENTION

The present invention has provided a control circuit, including a fail-safe timing arrangement, for use, for example, in fuel ignition control systems of the direct ignition type. The control circuit provides an interlock on start-up to prevent the energization of a fuel valve of the system during a trial for ignition period under certain failure conditions. Also, in accordance with the fail-safe timing arrangement, a component failure of the timing circuit results in a decrease in the duration of the trial for ignition interval. The control circuit also detects a leak condition for the valve and prevents the activation of the system for such condition. Moreover, the control circuit permits an ignition cycle to be initiated thereby preventing lockout of the system after a momentary power loss.

In accordance with the invention, the control circuit includes control means having first switching means, activate means operable to effect the energization of the control means over a first circuit path causing the first switching means to prepare an energizing path for a valve means of the system, valve actuating means, which may include flame sensing means and second switching means operable when enabled to complete the energizing path thereby effecting the energization of the valve means to permit fuel to be supplied to a burner apparatus for ignition to establish a flame, and timing means responsive to the first switching means to cause the flame sensing means to enable the second switching means for a predetermined time interval. The flame sensing means is operable to maintain the second switching means enabled when a flame is established during the time interval thereby maintaining the valve means energized. The flame sensing means causes the second switching means to interrupt the energizing path deenergizing the valve means if a flame fails to be established within the time interval.

For the purpose of providing interlock protection, the second switching means includes means for normally completing the first circuit path, and the control means is prevented from being energized by the activate means whenever the first circuit path is interrupted, as may occur for a malfunction of the second switching means or the flame sensing means, or for a leak condition for the valve means. Also, failure of the first switching means to operate when energized by the activate means prevents operation of the second switching means and thus the valve means.

In accordance with a disclosed embodiment, the flame sensing means, which controls the enabling of the second switching means, is continuously energized. Thus, in the event of a leak condition for the valve means which permits a flame to remain established following an ignition cycle, the flame sensing means maintains the second switching means enabled, interrupting the energizing path for the first switching means. Accordingly, the first switching means is prevented from responding to the activate means, and the system is maintained in a lockout state.

The timing means includes a resistance means and a capacitor which is permitted to be charged to a given value whenever the first switching means is disabled, the first switching means being operable when enabled to cause the capacitor to discharge over the resistance into the flame sensing means with the discharge time of the capacitor defining the trial for ignition interval. The capacitor is prevented from recharging until the first switching means is disabled so that the flame sensing means is disabled after the trial for ignition interval if a flame fails to be established.

Also, the use of the first switching means in controlling the charging and discharging of the capacitor results in a fail-safe timing arrangement wherein a component failure in the timing means will result in a decrease in the length of the trial for ignition interval with an attendant decrease in the time that unburned fuel is allowed to emanate from the burner apparatus.

The control means further includes an enabling means which delays the enabling of the first switching means for a time sufficient to ensure that the capacitor of the timing means is charged to the given value prior to the initiation of the next trial for ignition interval. Accordingly, the control circuit can manifest a failure in the delay means so that the flame sensing means and the timing means can be energized in response to the activate means. With such operation, and due to the interrelationship of the delay means and the timing means, any failure that eliminates the delay afforded by the delay means prevents the capacitor from charging, thereby preventing enabling of the flame sensing means. Also, the delayed enabling of the first switching means permits the timing means to be effective in enabling the flame sensing means to initiate an ignition cycle when power is restored following a momentary power interruption, preventing lock out of the system.

In disclosed embodiments, where the first and second switching means comprise respective first and second relays, the control circuit prevents start-up for a failure such as welded contacts for the relays. The first relay has normally open contacts and normally closed contacts which employ a common armature of the relay. The normally open contacts connect the capacitor of the timing means to a source of potential permitting the capacitor to be charged whenever the contacts are closed. The normally open contacts of the relay are operable to connect the capacitor to the flame sensing means to permit the capacitor to discharge over the flame sensing means. In the event the normally open contacts become welded together, the normally closed contacts cannot reclose, and thus, the capacitor cannot be recharged, preventing enabling of the flame sensing means during the next ignition cycle.

The second relay has normally closed contacts and normally open contacts which employ a common armature of the relay. The normally closed contacts are connected in the circuit path over which the interlock or control means is energized, and the normally open contacts are connected in the energizing path for the valve means. Should the normally open contacts become welded together, the normally closed contacts cannot reclose, preventing the energization of the control means and maintaining the system in a lock out state.

Thus, in the control circuit of the present invention, the switching means of the control means is enabled only if the second switching means is disabled, and a failure of the second switching means or the flame sensing means, or a leak condition for the valve means, will keep the control means disabled and the system locked out. Further, a failure of the interlock or control switching means prevents enabling of the flame sensing means, maintaining the system locked out. However, the delayed enabling of the interlock or control switching means permits restart of the system following a momentary loss of power.

DESCRIPTION OF THE DRAWING

The single FIGURE, which is the only drawing of the disclosure, is a schematic circuit diagram of a control circuit for a fuel ignition system of the direct ignition type provided by the present invention.

DESCRIPTION OF PREFERRED EMBODIMENTS

Referring to the drawing, there is illustrated a schematic circuit diagram for a control circuit 10 provided by the present invention. The control circuit 10 is described with reference to an application in a heating system of the direct ignition type which includes a fuel supply valve 12 operable when energized to supply fuel to a burner apparatus 13 for ignition by sparks provided by an igniter circuit 14.

The energization of the valve 12 and the igniter 14 is effected by a valve actuator circuit including a flame sensing circuit 16 which operates a switching device, embodied as a relay R1, which has normally open contacts R1B connected in an energizing path for the valve 12 and the igniter 14. A timing circuit 28 enables the flame sensing circuit 16 to operate relay R1 for a predetermined time, during a trial for ignition period initiated by the closing of thermostatically controlled contacts THS of an activate means, in response to a request for heat.

During the trial for ignition interval, the relay R1 is maintained energized, connecting power to the valve 12 and the igniter 14. When the fuel is ignited, the flame sensing circuit 16 senses the flame provided and maintains the relay R1 operated until the heating demand has been met as indicated by the opening of contacts THS. If, on the other hand, the fuel fails to be ignited during the ignition interval, the timing circuit 28 causes the flame sensing circuit 16 to deenergize relay R1 so that the valve 12 is deenergized and the system becomes locked out.

In accordance with the present invention, timing circuit 28 is enabled by an control or interlock circuit 30, which includes a switching device, embodied as a relay R2, and an associated delay circuit 34 which delays the operation of relay R2 for a given time after contacts THS close. The relay R2 is energized over normally closed contacts R1A of relay R1, and thus can be energized only if relay R1 is deenergized during the delay interval. Accordingly, the delay afforded by delay circuit 34, and the interlocking of relays R1 and R2 effectively provides a check for unsafe conditions, including a leak condition for the valve 12 or a circuit malfunction such as a component failure, welded relay contact or the like.

More specifically, the delay circuit 34 includes a controlled switching device, embodied as a programmable unijunction transistor 35, which is operable when enabled to complete an energizing path for relay R2. The delay network 34 further includes a timing network 36, including a capacitor 37, which controls the enabling of the PUT device 35. The capacitor 37 is permitted to charge in response to activation of the control circuit 10 following the closing of contacts THS, and when contacts R1A of relay R1 are closed, and after a delay established by the charging time of capacitor 37, the PUT device 35 is enabled, causing relay R2 to operate effecting the enabling of the flame sensing circuit 16 over the timing circuit 28.

The flame sensing circuit 16 includes a controlled switching device, embodied as a programmable unijunction transistor 40 which, together with associated timing networks 41 and 42, effect the enabling of a further controlled switching device, embodied as a silicon controlled rectifier 44 which controls the operation of relay R1. The timing network 41 which includes a capacitor 46, determines the anode potential for the PUT device 40, and the timing network 42, which includes a capacitor 48, shown as redundant capacitors 48' and 48'', determines the gate potential for the PUT device 40. The PUT device 40 is enabled whenever the anode to gate potential exceeds +0.6 volts.

The charging of capacitor 48 is controlled by the timing circuit 28 which includes a capacitor 61 which is charged when power is applied to the timing circuit 28 over conductors L3 and L4. A charging path is provided for capacitor 61 over a diode 63, a resistor 64 and normally closed contacts R2A of relay between conductors L3 and L4. The conductors L3 and L4 are connected over an isolation transformer T1 and conductors L1 and L2 which receive power supplied to terminals 53 and 54 of the control circuit 10, which are connectable to a 24 VAC source. Conductor L1 is preferably connected to terminal 53 over contacts THS so that the flame sensing circuit 16 and the timing circuit 28 are energized in response to the closing of contacts THS. In another embodiment, the flame sensing circuit 16 and the timing circuit 28 are continuously energized by connecting conductor L1 directly to terminal 53, with the thermostatically controlled contacts being connected in the incoming power line as indicated by the dotted lines having the reference indicia THS'.

When relay R2 operates, contacts R2B of relay R2 close permitting capacitor 61 to discharge over a resistor 62 into the timing network 42 of the flame sensing circuit 16, causing capacitor 48 to charge at a rate determined by the time constant of capacitor 61 and resistor 62, which defines the trial for ignition interval. Accordingly, the potential at the gate of the PUT 40 gradually increases as the capacitor 48 is charged by capacitor 61.

Capacitor 46, which determines the anode potential for the PUT device 40, is periodically charged over a resistor 47 by the AC signal supplied over conductors L3 and L4. As capacitor 48 is charging, following the operation of relay R2, capacitor 46 is charged during each cycle of the AC signal on conductors L3 and L4, and causes the PUT device 40 to conduct, whereby capacitor 46 discharges over the PUT device 40 into the gate circuit of the SCR device 44 which then conducts. When the SCR device 44 conducts, an energizing path is completed for the relay R1, which operates to connect power to the valve 12 and the igniter circuit 14.

The flame sensing circuit 16 further includes a flame sensor electrode 55 which is located in the proximity of the burner apparatus 13 in a spaced relationship therewith defining a gap 56. When the fuel is ignited, the flame bridges the gap 56 between the sensing electrode 55 and the burner apparatus, shown connected to a ground point for the control circuit 10. Accordingly, a relatively high impedance charging path, approximately 10megohms, is provided for capacitor 48 which permits the PUT device 40 to be pulsed into conduction by capacitor 46 during each cycle of the AC signal, causing relay R1, and thus the valve 12 to be maintained energized.

Referring to the igniter circuit 14, a capacitor 77 is periodically charged and then discharged over a transformer T2, under the control of a silicon controlled rectifier 73, causing sparks to be provided between ignition electrodes 74 which are located adjacent to the burner apparatus 13. The SCR device 73 is in turn controlled by a timing network 75, including a capacitor 76. The capacitor 76 is effectively shunted by normally closed contacts R1C or relay R1, which are opened when relay R1 operates, permitting the capacitor 76 to enable the igniter circuit 14 for a predetermined time following operation of relay R1, permitting periodic spark generation for such time.

Briefly, in operation of the control circuit 10, when the energization of the flame sensing circuit 16 and the timing circuit 28 are controlled by contacts THS, then when contacts THS are open, the circuit 10 is deactivated with relays R1 and R2 deenergized and the valve 12 the igniter circuit 14, the flame sensing circuit 16 and timing circuit 28 deenergized so that capacitor 61 is discharged.

In response to the closing of contacts THS, the flame sensing circuit 16 and the timing circuit 28 are energized, and capacitor 61 is permitted to charge. The control circuit 30 is also energized over contacts THS and contacts R1A of relay R1, permitting capacitor 37 to charge. After the delay provided by the charging time of capacitor 37, the PUT device 35 is enabled, completing the energizing path for relay R2 which operates.

When relay R2 operates, contacts R2A open, interrupting the charging path for capacitor 61 and contacts R2B close to permit capacitor 61 to discharge into the timing network 42 of the flame sensing circuit 16, causing capacitor 48 to charge at a rate determined by the discharge time of capacitor 61. Capacitor 46 also charges over resistor 47 increasing the potential at the anode of the PUT device 40 to a value which exceeds the gate potential, permitting the PUT device 40 to conduct, discharging capacitor 46 into the gate of the SCR device 44 which then conducts, causing relay R1 to operate opening contacts R1A, which are now shunted by contacts R2C of relay R2. In addition, contacts R1B close connecting power to the valve 12 which operates to supply fuel to the burner 13. The igniter circuit 14 is also energized to generate sparks for igniting the fuel. The igniter circuit 14 operates for a time determined by capacitor 76 which may be in the order of 10 seconds.

When the fuel is ignited, the flame bridges the gap 56 between the sensing electrode 55 and ground, controlling the charging of capacitor 48 such that the PUT device 40 conducts during each cycle of the AC signal as long as the flame remains established at the burner apparatus 13.

If the fuel fails to be ignited within the trial for ignition period established by the discharge time of the capacitor 61, capacitor 48 becomes discharged to a value which allows the PUT device 40 to conduct early in the cycle before capacitor 46 has received sufficient charge to fire the SCR device 44. Accordingly, the SCR device 44 in no longer enabled, and the relay R1 becomes deenergized. When relay R1 drops out, contacts R1B open, deenergizing the valve 12 and interrupting the supply of fuel to the burner 13. Since capacitors 61 and 48 are discharged, the flame sensing circuit 16 maintains the relay R1 deenergized and the system does not recycle until contacts THS open and reclose, permitting relay R2 to drop out.

In the event of an unsafe failure in the flame sensing circuit 16 which permits relay R1 to be operated in the absence of a flame, or for a leak condition for the valve 12 which permits a flame to remain established following the deactivation of the control circuit 10, relay R1 will be energized as soon as the flame sensing circuit 16 is energized on the next call for heat. When relay R1 is energized, contacts R1A are open and contacts R1B are closed so that the energizing path for valve 12 and the control circuit 30 is interrupted. Thus, the start up of the system is prevented. It is apparent that when the flame sensing circuit 16 is continuously energized, relay R1 remains operated for the above failure conditions.

Moreover, the start up of the system is also prevented in the event of failure of either one of the relays R1 or R2 due to the interlock arrangement of the control circuit 10 which permits the relays R1 and R2 to check one another. For example, if contacts R1A are open at start up, the control circuit 30 cannot be energized and the circuit 10 is locked out. Also, if contact R2A remain open following a heating cycle, capacitor 61 cannot be recharged and the flame sensing circuit 16 will remain disabled when contacts THS close.

The delay in operation of relay R2 provided by the delay network 34 prevents the control circuit 10 from becoming locked out following a momentary interruption of power. When power is restored, the delayed operation of relay R2 affords sufficient time for capacitor 61 to charge to a value that is sufficient to energize the flame sensing circuit 16, permitting the control circuit 10 to recycle when power is reapplied.

While the timing arrangement including control circuit 30 and timing circuit 28 is described in an application in a fuel ignition control circuit, such timing arrangement may be used in other applications where it is desired to effect operation of a functional device for a given time interval.

DETAILED DESCRIPTION

Power is applied to the control circuit 10 over terminals 53 and 54 which are connectable to a 24VAC source. Power is extended to the control circuit 30 over conductors L1' and L2. Conductor L1' is connected to terminal 53 over contacts THS and contacts R1A of relay R1, conductor L2 being connected to terminal 54.

With reference to the interlock circuit 30, the PUT device 35 has an anode control network, including the operate coil 32 of relay R2 and a resistor 33, which operate as a voltage divider to establish a potential at the anode of the PUT device 35 when power is applied to conductor L1'. Operate coil 32 and resistor 33 are connected between conductors L1' and L2 in a series circuit with a diode 19 which extends from conductor L1' over diode 19, and the winding 32 to the anode of the PUT device 35 and over resistor 33 to conductor L2. A capacitor 17 is connected in parallel with winding 32 and resistor 33.

The PUT device 35 has a gate control network including capacitor 37, resistors 38 and 39 and a diode 18, which form a unidirectional series charging path for capacitor 37 which extends from conductor L1' over diode 19, capacitor 37, and resistor 38 to conductor L2. The junction of capacitor 37 and resistor 38 to point 29 is connected over resistor 39 to the gate of the PUT device 35. Diode 18 is connected between conductor L2 and point 29 in parallel with resistor 38. The cathode of the PUT device is connected to conductor L2, and thus, the PUT device 35 has its anode-cathode circuit connected in series with the operate coil 32 of relay R2 between conductors L1' and L2 and is operable when enabled to effect energization of the relay R2.

The PUT device 35 is enabled when the potential at its anode exceeds the potential at its gate by +0.6 volts. Thus, when capacitor 37 has charged to a value that causes the potential at the gate of PUT device 35 to be 0.6 volts less than the potential at the anode of the PUT device 35, the PUT device 35 is enabled, energizing the relay R2. Thereafter, the PUT device 35 is enabled during each positive half cycle of the AC signal, the relay R2 being maintained energized during negative half cycles by capacitor 17.

When relay R2 operates, contacts R2A open and contacts R2B close, permitting the timing circuit 28 to energize the flame sensing circuit 16. Also, normally open contacts R2C, which are connected in shunt with contacts R1A of relay, are closed providing a holding path for the interlock relay R2, when relay R1 operates.

Relay R2 is a double-pole, double-throw relay (DPDT) with contacts R2A and R2B employing a common armature of the relay R2 such that whenever contact R2A is closed, contact R2B is open. Also, should contact R2B become welded, contact R2A cannot reclose so that capacitor 61 cannot be charged.

Referring to the timing circuit 28, capacitor 61 is connected in a series charging path including a diode 63, a resistor 64 and normally closed contacts R2A of relay R2 between conductors L3 and L4, to be charged when an AC signal is provided on conductors L3 and L4, and when contacts R2A are closed. Power is supplied to conductors L3 and L4 over transformer T1 which has a primary winding 51 connected over conductor L1 (and contacts THS) and conductor L2 to terminals 53 and 54 respectively, and a secondary winding 52 connected to conductors L3 and L4. As indicated above, conductor L1 may be connected directly to the terminal 53.

When relay R2 operates, capacitor 61 discharges into the timing network 42 of the flame sensing circuit 16 over a circuit path including contacts R2B of relay R2, which close when relay R2 operates, resistor 62 and a diode 65, which are connected in series between one side of the capacitor at point 70 and one side of capacitor 48 at point 71. Point 71 is also connected to circuit ground for the control circuit 10.

As indicated above, timing network 42, which includes capacitor 48, determines the gate potential for the PUT device 40. Capacitor 48 is embodied as redundant capacitors 48' and 48'' which are connected in parallel between ground at point 71 and conductor L4. A resistor 66 is connected between point 71 and the gate electrode of the PUT device 40.

The anode of the PUT device 40 is connected over resistor 47 to conductor L3, and over capacitor 46 to conductor L4. Accordingly, when the PUT device 40 is disabled, capacitor 46 is charged over resistor 47 during positive half cycles of the AC signal, that is when conductor L3 is positive relative to conductor L4.

The cathode of the PUT device 40 is connected to the gate of the SCR device 44, a resistor 49, embodied as redundant resistors 49' and 49'', being connected between the cathode of the PUT device 40 and conductor L4.

The SCR device 44, which controls the energization of the relay R1, has its anode connected to one side of the operate winding 72 of the relay R1, the other side of which is connected to conductor L3. The cathode of the SCR device 44 is connected to conductor L4 so that when the SCR device 44 is enabled, the operate winding 72 of relay R1 is connected between conductors L3 and L4 permitting the relay R1 to operate.

The PUT device 40, which controls the enabling of the SCR device 44, is pulsed into operation, providing an enabling pulse for the SCR device 44 for a portion of each cycle of the AC signal during the trial for ignition interval. During the portion of the AC cycle when SCR device 44 is non-conducting, the relay R1 is maintained energized by capacitor 68 and free-wheeling diode 69 which are connected in parallel with the operate winding 72 of relay R1.

Relay R1 is a double-throw, double-pole relay (DPDT) with contacts R1A and R1B employing a common armature of the relay such that whenever contact R1A is closed, contact R1B is open. Also, should contact R1B become welded, contact R1A cannot reclose, thereby preventing energization of the interlock circuit 30 on the next call for heat.

When relay R1 operates, contacts R1A are opened, interrupting the energizing path for the interlock circuit 30, which is then maintained energized by contacts R2C of relay R2 which extend the AC signal to conductor L1'. Contacts R1B of relay R1, which are connected between conductor L1' and a conductor L1", also close to extend the AC signal to the fuel supply valve 12 and the igniter circuit 14.

The fuel valve 12 has an operate solenoid 15 connected between conductors L1" and L2 and is thus energized when contacts R1B close, to open the valve permitting fuel to be supplied to the burner apparatus 13 for ignition by sparks provided by the igniter circuit 14.

Considering the igniter circuit 14, the igniter circuit, which is similar to the igniter circuit disclosed in the copending U.S. Patent application Ser. No. 698,161, now U.S. Pat. No. 4,070,143 of G. Dietz, includes a capacitor 77 which is charged and then discharged under the control of SCR 73, over a primary winding 78 of an ignition transformer T2 during alternate half cycles of the AC signal to provide sparks over ignition electrodes 74 which are connected to the secondary winding 79 of the transformer T2.

The igniter circuit 14 includes a voltage doubler circuit including capacitor 81 which supplies a voltage to capacitor 77, enabling capacitor 77 to be charged to approximately twice the line voltage. Capacitor 81 has a charging path which extends from conductor L1" over a diode 86 and the capacitor 81 to ground. Capacitor 81 is charged when conductor L1" is positive relative to conductor L2. When conductor L1" is negative relative to conductor L2, capacitor 77 charges over a path which extends from ground over capacitor 81, a resistor 83, capacitor 77, and a diode 84 to conductor L1", with the voltage on capacitor 81 being transferred to capacitor 77. During the next half cycle, as the AC signal on conductor L1" begins to decrease from its peak value, capacitor 77 causes current flow through resistor 83 and capacitor 81, through the winding 51 of the transformer T1 and contacts R2C and R1B and capacitor 76 and thence over diode 88 and the gate to cathode circuit of the SCR device 73 to the other side of the capacitor 77. Such current flow causes the SCR device 73 to conduct.

The SCR device 73 has its anode-cathode circuit connected in series with the primary winding 78 of the transformer T2 in shunt with capacitor 77. Thus, when the SCR device 73 conducts, capacitor 77 discharges rapidly over the primary winding 78, inducing a voltage pulse in the secondary winding 79. Such pulse is applied to the electrodes 74 generating a spark therebetween for igniting fuel supplied to the burner 13.

Such operation continues, with an ignition spark being provided for each cycle of the AC signal until capacitor 76 is fully charged. At such time, further charging of capacitor 76 is inhibited, and the generation of further sparks is inhibited. In one embodiment, the values of capacitors 76 and 77 and the resistors 82 and 83 were selected to permit sparks to be provided for ten seconds following the operation of relay R1.

Referring again to the flame sensing circuit 16, the flame sensing electrode 55 is connected to conductor L3 and positioned adjacent to the grounded burner 13 in a spaced relationship defining gap 56. When a flame is provided at the burner, the flame bridges the gap 56, permitting rectified flame current flow from conductor L3 over the flame to ground, and thus to the timing network 42 at point 71. This provides a potential at point 71 which permits the PUT device 40 to be rendered conductive in each cycle of the AC signal while a flame is established, keeping relay R1 energized.

OPERATION

When the control circuit 10 is deactivated, that is when contacts THS are open, the interlock circuit 30, including relay R2, the valve 12 and the igniter circuit 14 are deenergized. The flame sensing circuit 16, including relay R1, and timing circuit 28 are also deenergized, and capacitor 61 is discharged.

When contacts THS close in response to a request for heat, the 24 VAC signal supplied to terminal 53 is extended over contacts THS to conductor L1 and over contacts R1A to conductor L1'. Accordingly power is supplied to conductors L3 and L4, permitting capacitor 61 to charge. Then during positive half cycles of the AC signal, current flow over diode 19, the capacitor 37 and resistor 38 charges capacitor 37. Initially, the potential at point 29 and thus at the gate of the PUT device 35 is sufficiently greater than the potential at the anode of the PUT device 35 established by the voltage divider formed by winding 32 of relay R2 and resistor 33. Thus, the PUT device is maintained off. As capacitor 37 charges during successive cycles of the AC signal, the potential at point 29 decreases. The time constant of resistor 38 and capacitor 37 is selected to provide a delay of approximately 3 seconds before the potential at the gate of the PUT device 35 decreases to a value at which the anode potential exceeds the potential at the gate of the PUT device 35 by 0.6 volts. At such time, the PUT device 35 is enabled so that relay R2 is energized.

The delay in operation of relay R2 prevents the control circuit 10 from being locked out on a line voltage interruption. In the event of a monentary loss of power, the operation of relay R2 is delayed, following restoration of power, for a time which enables capacitor 61 to accumulate charge sufficient to energize the flame sensing circuit 16. In the disclosed enbodiment, wherein the delay network 34 provides a three second delay, capacitor 61 is permitted to charge during this three second interval. The actual charging time required depends on the value of capacitor 61, but is typically in the order of a few milliseconds.

When relay R2 operates, contacts R2A open and contacts R2B close, permitting the timing circuit 28 to energize the flame sensing circuit 16. Also, contacts R2C, which are connected in parallel with contacts R1A of relay R1, close, providing a holding path for the relay R2 when relay R1 operates.

Referring to the flame sensing circuit 16 and the timing circuit 28, prior to operation of relay R2, the timing circuit 28 inhibits the operation of the PUT device 40. When relay R2 operates, contacts R2A open and contacts R2B close, permitting capacitor 61 to discharge into timing network 42 of the flame sensing circuit for charging capacitor 48 at a rate determined by the time constant established by capacitor 61 and resistor 62.

After relay R2 operates, then during the first positive half cycle of the AC signal when conductor L3 is positive relative to conductor L4, capacitor 46 charges over resistor 47, increasing the potential at the anode of the PUT device 40. Capacitor 48 is charged by discharge current provided by capacitor 61, establishing a potential at the gate of the PUT device 40. Due to the charge on capacitor 48, initially capacitor 46 must charge for a major portion of the positive half cycles of the AC signal to raise the anode potential to a value which is +0.6 volts greater than the gate potential, to cause the PUT device 40 to conduct. When the PUT device 40 conducts, capacitor 46 discharges over the anode-cathode circuit of the PUT device 40 and resistor 49 providing sufficient discharge current to enable the SCR device 44 which then conducts.

When SCR 44 conducts, the operate winding 72 of relay R1 is energized, and the relay operates, opening contacts R1A and R1C, and closing contacts R1B, connecting the AC power signal to conductor L1″. Accordingly, the valve 12 is energized supplying fuel to the burner apparatus 13, and the igniter circuit is energized and operates as described above to provide sparks for igniting the fuel.

During negative half cycles of the AC signal, the SCR device 44 is reverse biased, and relay R1 is maintained energized by capacitor 68 and free-wheeling diode 69. The PUT device 40 is disabled in response to the discharge of capacitor 46. The discharge of capacitor 48 is prevented by diode 65 which is reverse biased during negative half cycles of the AC signal. The charge on capacitor 48 leaks off through gate resistor 66 and the gate to cathode circuit of the PUT device 40, and it is just a matter of time, that is the trial for ignition interval, before the charge on capacitor 61 has completely transferred to capacitor 48 and then to ground via the PUT device 40.

Thereafter, the PUT device 40 is pulsed into operation during successive cycles of the AC signal under the control of flame sensing networks 41 and 42, enabling the SCR device 44 to maintain the relay R1 operated during th trial for ignition interval, the duration of which is defined by capacitor 61. Also, the igniter circuit 14 continues to provide sparks in the proximity of the burner 13 until capacitor 76 is fully charged.

Generally the fuel is ignited within a few seconds, establishing a flame at the burner 13. The flame bridges the gap 56 between the sensing electrode 55 and the grounded burner 13, permitting rectified flame current to flow from cconductor L3 over the electrode 55 and the flame to ground at point 71, and over capacitor 48 to conductor L4, charging the capacitor 48. The relative time constants for the timing networks are selected so that when a flame is established, capacitor 46 charges at a faster rate than capacitor 48, permitting the PUT device 40 to be enabled during each cycle of the AC signal, maintaining the relay R1 operated after the trial for ignition interval.

If a flame fails to be established within the trial for ignition interval, the charge on capacitor 61 is dissipated through capacitor 48 until the voltage on capacitor 48 drops to a low value permitting the anode of the PUT device 40 to exceed the gate potential very early in the cycle and before capacitor 46 has stored enough energy to fire the SCR device 44. Therefore, the PUT device 40 fires every cycle, but the energy on capacitor 46 is too low to cause SCR 44 to conduct. Accordingly, after a short delay established by capacitor 68 and diode 69, the relay R1 drops out.

When the heating demand has been met, contacts THS open, disconnecting power from the control circuit 10 deactivating the system so that the valve 12 and relays R1 and R2 are deenergized. For the embodiment where the flame sensing circuit 16 is continuously energized, then when contacts THS open, the interlock circuit 30, the valve 12 and the igniter 14 are deenergized. When relay R2 releases, contacts R2B and R2C open and contacts R2A close, permitting capacitor 61 to be charged. When the valve 12 is deenergized, the supply of fuel to the burner 13 is interrupted and the flame is extinguished. The flame sensing circuit 16 responds to the loss of flame to deenergize relay R1, causing contacts R1B to open and contacts R1A and R1C to close, and the control circuit 10 is prepared for the next ignition cycle.

As indicated above, the delay provided by delay network 34 and the interlocking of relays R1 and R2 provides a means for checking for unsafe conditions including a leak condition for the valve 12 or a circuit malfunction such as a component failure, welded contact or the like. In the event of a leak condition for the valve 12, the burner flame will remain established following deactivation of the control circuit 10 when the heating demand has been met. When the flame sensing circuit 16 is continuously energized, then for a leak condition, the flame bridging the gap 56 will permit rectified current to flow from conductor L3 through the flame and capacitor 48, charging capacitor 48 during each cycle of the AC signal, and causing the PUT device 40 to be enabled so that relay R1 is maintained energized. For such condition, as well as for a component failure of the flame sensing circuit 16 which permits relay R1 to be operated in the absence of a flame, contacts R1A are maintained open, preventing energization of the interlock circuit 30, the fuel valve 12 and the ignition circuit 14 on the next call for heat. The operation is similar when the flame sensing circuit 16 is energized in response to the closing of contacts THS.

For the condition where contacts R1B become welded together, contacts R1A, which use a common armature with contacts R1B, remain open when relay R1 is deenergized, preventing energization of the interlock relay R1 and the valve 12. If contacts R2B of relay R2 become welded, then contacts R2A, which employ a common armature, cannot reclose, preventing the charging of capacitor 61.

For a momentary power interruption, the valve 12 and relays R1 and R2 are deenergized. If the flame remains established, then when power is restored, relay R1 is reenergized, opening contacts R1A and preventing energization of the interlock circuit 30 until the flame is extinguished. At such time, relay R1 drops out, opening contacts R1A, and the control circuit 10 recycles in the normal manner. The delayed operation of relay R2 provides sufficient charging time for capacitor 61 to assure energization of the flame sensing circuit 16 when relay R2 operates. In the event of a failure of relay R2 while relay R2 is energized, the control circuit 10 is locked out on a short power interruption.

The combination of contacts R2B and R2A, capacitor 61 and resistor 62 provide a safe timing arrangement. In other RC timing circuits, the timing is changed, increased by a leaky capacitor or an increase in resitance as due to bad solder joints. In the timing arrangement of the present invention, known capacitor failures, leakage, or high resistance will result in a decrease in the trial for ignition period which is safe. A decrease in the trial for ignition period is safe because all appliances are tested for delayed ignition, that is, unburned fuel is allowed to flow for the trial for ignition period then it is ignited. The appliances must withstand this test without emitting flame. Any increase in this trial for ignition interval due to a change in the timing circuit can be hazardous. The timing arrangement of the control circuit of the present invention affords fail safe timing and a failure of the timing circuit will result in a decrease in the length of the trial for ignition period.

Also, in view of the delayed operation of relay R2 under the control of delay network 34, any failure that will eliminate the delay of network 34 will prevent the timing capacitor 61 from charging and will decrease or eliminate the trial for ignition period and cause the circuit to lock out. Further, any failure that causes relay R1 to energize without a flame will lockout relay R2 because of the delay network 34.

I claim:

1. In a fuel ignition system including valve means operable when energized to supply fuel to a burner apparatus for ignition to establish a flame at said burner apparatus, a control circuit comprising control means including switching means, activate means responsive to a first condition to effect the energization of said control means over a first circuit path causing said switching means to operate and complete a portion of an energizing path for said valve means, flame sensing means operable when enabled to complete said energizing path thereby effecting the energization of said valve means to permit fuel to be supplied to said burner apparatus, and ignition timing means responsive to operation of said switching means to generate a timing signal defining a trial for ignition time interval, said timing signal below coupled to said flame sensing means by said switching means, to enable said flame sensing means for said trial-for-ignition time interval, said flame sensing means being operable to maintain said valve means energized when a flame is sensed at said burner apparatus during said time interval, and to cause the deenergization of said valve means when a flame fails to be sensed during said time interval.

2. A system as set forth in claim 1 wherein said flame sensing means includes further switching means for normally completing said first circuit path, said control means being prevented from responding to said activate means whenever said first circuit path is interrupted.

3. A system as set forth in claim 2 wherein said flame sensing means further includes circuit means responsive to said timing means to enable said further switching signal during said time interval and responsive to a flame at said burner apparatus to maintain said further switching means enabled after said time interval, said further switching means preventing the energization of said first-mentioned switching means in the event said further switching means becomes enabled in the absence of a flame.

4. A system as set forth in claim 2 wherein said activate means is responsive to a second condition to interrupt said energizing path to thereby effect the deenergization of said valve means, said further switching means being maintained enabled, interrupting said first circuit path, in the event that the flame fails to be extinguished when said valve means is deenergized.

5. A system as set forth in claim 1 wherein said timing means includes a timing network having a capacitor which when connected to a source of potential is charged to a given value, said switching means being operable to cause said capacitor to discharge over said flame sensing means for enabling said flame sensing means.

6. A system as set forth in claim 5 wherein said switching means has first normally closed contacts and second normally open contacts, said first contacts connecting said capacitor to said source of potential to permit said capacitor to be charged to said given value, said timing means further including circuit means including resistance means connected in a series circuit path with said second contacts between one side of said capacitor and an enabling input of said valve actuating means to provide a discharge path for said capacitor over said valve actuating means whenever said second contacts are closed.

7. A system as set forth in claim 5 wherein said switching means normally connects said capacitor to said source of potential and is operable when enabled to disconnect said capacitor from said source of potential to thereby prevent said capacitor from recharging while said switching means is enabled.

8. A system as set forth in claim 5 wherein said control means includes enabling means responsive to said activate means for enabling said switching means, said enabling means including further timing means for delaying the enabling of said switching means for a given time after said control means is energized to permit said capacitor to charge to said given value before said switching means is enabled, said capacitor being prevented from charging to said given value in the event that said enabling means fails to delay the enabling of said switching means thereby preventing the enabling of said flame sensing means for said time interval.

9. In a fuel ignition system including valve means operable when energized to supply fuel to a burner apparatus for ignition to establish a flame at said burner apparatus, a control circuit comprising control means including a checking relay having first normally closed contacts and second normally open contacts, activate means operable to effect the energization of said relay over a circuit path including third normally closed contacts, valve actuating means operable when enabled to energize said valve means and to open said third contacts, and ignition timing means controlled by said checking relay to enable said valve actuating means during a trial for ignition interval, said ignition timing means including a capacitor and resistance means, said first contacts connecting said capacitor to a source of potential to permit said capacitor to be charged to a given value when said first contacts are closed, said resistance means being connected in a series circuit path with said second contacts between one side of said capacitor and an enabling input of said valve actuating means to provide a discharge path for said capacitor over said valve actuating means when said relay operates to close said second contacts whereby said valve actuating means energizes said valve means for a trial-for-ignition time interval defined by the discharge time of said capacitor, said valve actuating means being operable to maintain said valve means energized only when a flame is established at said burner apparatus during said trial-for-ignition time interval and to cause deenergization of said valve means whenever a flame fails to be established at said burner apparatus during said time interval.

10. A system as set forth in claim 9 wherein said control means includes enabling means responsive to said activate means for energizing said checking relay after a predetermined delay to permit said capacitor to charge to said given value before said relay is energized, said capacitor being prevented from charging to said value whenever said enabling means fails to delay the energizing of said relay, thereby preventing the enabling relay, thereby preventing the enabling actuating means for said trial-for-ignition time interval.

11. In a fuel ignition system including valve means operable when energized to supply fuel to a burner apparatus for ignition to establish a flame at said burner apparatus, a control circuit comprising control means including first normally disabled switching means and enabling means, activate means operable to energize said enabling means over a circuit path to cause said first switching means to be enabled, second switching means operable when enabled to interrupt said circuit path and to energize said valve means to permit fuel to be supplied to said burner apparatus, flame sensing means, and ignition timing means including a timing network having a capacitor and circuit means for permitting said capacitor to charge to a given value, said first switching means being operable when enabled to connect said timing network to an enabling input of said flame sensing means to permit said capacitor to discharge over said flame sensing means to thereby cause said flame sensing means to enable said second switching means for a time interval defined by the discharge time of said capacitor, said flame sensing means being operable to maintain said second switching means enabled when a flame is sensed at said burner apparatus during said time interval thereby maintaining said valve means energized, and to cause said second switching means to interrupt said energizing path thereby deenergizing said valve means when a flame fails to be sensed at said burner apparatus during said time interval.

12. A system as set forth in claim 11 wherein said second switching means interrupts said circuit path whenever a flame is established at said burner apparatus, preventing said first switching means from responding to said activate means.

13. A system a set forth in claim 11 wherein said activate means is operable to connect said flame sensing means and said timing means to a source of potential.

14. A system as set forth in claim 11 wherein said flame sensing means to connected directly to a source of potential for energization thereby to permit said flame sensing means as enabled by said timing means to maintain said second switching means enabled as long as a flame is established at said burner apparatus.

15. A system as set forth in claim 11 wherein said circuit means includes first resistance means connected in a charging circuit with said capacitor whenever said first switching means is disabled, and second resistance means connected in a discharge path with said capacitor over said flame sensing means whenever said first switching means is enabled.

16. A system as set forth in claim 11 wherein said flame sensing means includes a controlled switching device and further timing means for controlling said controlled switching device, said first switching means causing said capacitor to dicharge over said further timing means for enabling said controlled switching device during said time interval, said flame sensing means including sensor means responsive to a flame at said burner apparatus for causing said further timing means to enable said controlled switching device after said time interval for maintaining said second switching means enabled.

17. In a fuel ignition system including valve means operable when energized to supply fuel to a burner apparatus for ignition to establish a flame at said burner apparatus, a control circuit comprising control means including first switching means, activate means operable to effect the energization of said control means over a circuit path including first normally closed contacts, for causing said first switching means to operate and close second contacts to provide a holding path for said control means, second switching means operable when enabled to open said first contracts, whereby said control means is maintained energized over said holding path, and to close third contacts to connect said valve means to said holding path for energization to permit fuel to be supplied to said burner apparatus, flame sensing means, and ignition timing means including a timing capacitor which is permitted to charge while said first switching means is disabled and which discharges over said flame sensing means responsive to operation of said first switching means to cause said flame sensing means to enable said second switching means for a predetermined time interval, defined by the discharge time of said capacitor, said flame sensing means being operable to maintain said second switch means enabled when a flame is established at said burner apparatus during said time interval thereby maintaining said valve means energized, and to cause said second switching means to open said third contacts to disconnect said valve means from said holding path thereby deenergizing said valve means when a flame fails to be sensed during said time interval.

18. A system as set forth in claim 17 wherein said first switching means has fourth normally closed contacts connecting said timing means to a source of potential to permit said capacitor to charge while said first switching means is disabled, said first switching means having fifth normally open contacts for connecting said capacitor to said flame sensing means for enabling said capacitor to dicharge over said flame sensing means when said first switching means is enabled.

19. A system as set forth in claim 18 wherein said first switching means comprises a relay having said fourth and fifth contacts operated by a common armature, whereby said fourth contacts are prevented from reclosing following disabling of said relay whenever said fifth contacts become welded together.

20. A system as set forth in claim 17 wherein said second switching means comprises a relay having said first and third contacts operated by a common armature whereby said first contacts are prevented from reclosing following disabling of said relay whenever said third contacts become welded together.

21. In a control arrangement for operating a functional device having an associated actuating means, the combination comprising timing means including a capacitor and resistance means, and control means including a relay having first normally closed contacts and second normally open contacts, said first contacts connecting said capacitor to a source of potential to permit said capacitor to be charged to a given value when said first contacts are closed, said resistance means being connected in a series circuit path with said second contacts between one side of said capacitor and an enabling input of said actuating means to provide a discharge path for said capacitor over said actuating means whenever said relay is operated to close said second contacts, whereby said timing means enables said actuating means causing the energization of said functional device for a predetermined time interval defined by said resistance means and said capacitor, said timing means being prevented from enabling said actuating means after said time interval as long as said relay remains operated.

22. A control arrangement as set forth in claim 21 wherein said relay is operable when enabled to open said first contacts to disconnect said capacitor from said source of potential to thereby prevent said capacitor from recharging while said relay remains operated.

23. A control arrangement as set forth in claim 21 wherein said control means includes enabling means responsive to the connection of power thereto for enabling said relay, said enabling means including further timing means for delaying the enabling of said relay for a given time after power is connected to said control means, permitting said capacitor to charge to said given value before said relay is enabled, said capacitor being prevented from charging to said given value in the event that said enabling means fails to delay the operation of said relay, thereby preventing said actuating means from being enabled for said predetermined time interval.

* * * * *

UNITED STATES PATENT OFFICE

CERTIFICATE OF CORRECTION

PATENT NO. : 4,116,613
DATED : September 26, 1978
INVENTOR(S) : Russell Byron Matthews It is certified that error appears in the above-identified patent and that said Letters Patent are hereby corrected as shown below:

Column 13, line 32 "below" should be -- being --;

Column 13, line 47, "means" should be -- signal --;

Column 13, line 48, "signal" should be -- means --;

Column 14, line 9, "valve actuating" should be -- flame sensing --;

Column 14, line 11, "valve actuating" should be -- flame sensing --;

Column 15, line 3, cancel "relay, thereby preventing the enabling" and substitute therefor -- of said valve --;

Column 15, line 42, "to" should be -- is --;

Column 16, line 36, "dicharge" should be -- discharge --

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*